US010504403B2

(12) United States Patent
Park

(10) Patent No.: US 10,504,403 B2
(45) Date of Patent: Dec. 10, 2019

(54) LIQUID CRYSTAL PANEL, LIQUID CRYSTAL DISPLAY DEVICE, AND METHOD FOR DRIVING SAME

(71) Applicant: LG Display Co., Ltd., Seoul (KR)

(72) Inventor: Sun Kyu Park, Daegu (KR)

(73) Assignee: LG Display Co., Ltd., Seoul (KR)

( * ) Notice: Subject to any disclaimer, the term of this patent is extended or adjusted under 35 U.S.C. 154(b) by 129 days.

(21) Appl. No.: 15/322,084

(22) PCT Filed: Jul. 15, 2015

(86) PCT No.: PCT/KR2015/007380
§ 371 (c)(1),
(2) Date: Dec. 23, 2016

(87) PCT Pub. No.: WO2016/010376
PCT Pub. Date: Jan. 21, 2016

(65) Prior Publication Data

US 2017/0148369 A1 May 25, 2017

(30) Foreign Application Priority Data

Jul. 15, 2014 (KR) ..... 10-2014-0089163
Jul. 15, 2015 (KR) ..... 10-2015-0100661

(51) Int. Cl.
*G09G 3/36* (2006.01)
*G09G 3/20* (2006.01)

(52) U.S. Cl.
CPC ..... *G09G 3/2007* (2013.01); *G09G 3/3648* (2013.01); *G09G 2300/0434* (2013.01);
(Continued)

(58) Field of Classification Search
CPC ..... G09G 3/36; G09G 3/2007; G09G 3/3648
See application file for complete search history.

(56) References Cited

U.S. PATENT DOCUMENTS 7,375,707 B1 * 5/2008 Lee ..... G09G 3/3648 345/89
2004/0169629 A1 9/2004 Lee et al.
(Continued)

FOREIGN PATENT DOCUMENTS

JP 2004-530171 A 9/2004
KR 10-2003-0073071 A 9/2003
(Continued)

OTHER PUBLICATIONS

PCT International Search Report, PCT/KR2015/007380, dated Nov. 5, 2015, 3 Pages.

*Primary Examiner* — Vijay Shankar
*Assistant Examiner* — Cory A Almeida
(74) *Attorney, Agent, or Firm* — Fenwick & West LLP

(57) ABSTRACT

The present invention relates to a liquid crystal display (LCD) device which is capable of improving picture quality by switching an optimal gamma voltage and an optimal common voltage on a basis of an operation time, and a method for driving the same. The liquid crystal display device includes a timing controller, a voltage generating unit, a data driver, and a liquid crystal panel. The timing controller can generate voltage control signal for switching initial state to stable state by using certain switching point. The voltage generating unit can receive the voltage control signal, supply the first gamma voltage and the first common voltage during the initial state, and supply the second gamma voltage and the second common voltage during the stable state. The data driver can receive the first gamma voltage in the initial state and the second gamma voltage in the stable state. The liquid crystal panel can suppress short-term residual image if the first gamma voltage and the first common voltage are supplied, and can suppress long-term
(Continued)

residual image if the second gamma voltage and the second common voltage are supplied.

14 Claims, 9 Drawing Sheets

(52) U.S. Cl.
CPC . *G09G 2310/08* (2013.01); *G09G 2320/0247* (2013.01); *G09G 2320/0257* (2013.01); *G09G 2320/0276* (2013.01); *G09G 2320/048* (2013.01); *G09G 2320/0673* (2013.01)

(56) References Cited

U.S. PATENT DOCUMENTS

| | | | | |
|---|---|---|---|---|
| 2006/0097969 | A1* | 5/2006 | Tsai | G09G 3/20 345/88 |
| 2007/0211006 | A1 | 9/2007 | Lee et al. | |
| 2008/0150930 | A1 | 6/2008 | Nam et al. | |

FOREIGN PATENT DOCUMENTS

| | | | | | |
|---|---|---|---|---|---|
| KR | 10-2008-0034573 | A | | 4/2008 | |
| KR | 20080034573 | | * | 4/2008 | G02F 1/133 |
| KR | 10-2008-0060077 | A | | 7/2008 | |
| KR | 10-2010-0009405 | A | | 1/2010 | |
| KR | 20100009405 | | * | 1/2010 | G02F 1/133 |

* cited by examiner

LIQUID CRYSTAL PANEL, LIQUID CRYSTAL DISPLAY DEVICE, AND METHOD FOR DRIVING SAME

TECHNICAL FIELD

The present invention is related to a liquid crystal panel, a liquid crystal display device and a method for driving the same, in which display quality can be improved by switching a common voltage and a gamma voltage on the basis of an operation time.

BACKGROUND ART

Owing to a technological development for mass production, an easy driving means, a low power consumption, a high picture quality and a realization of large screen, a liquid crystal display (LCD) device is appropriate for a portable device, and furthermore its application field has gradually increased.

According to a method for controlling an alignment of a liquid crystal layer in the LCD device, the LCD device may be developed in various modes, for example, Twisted Nematic (TN) mode, Vertical Alignment (VA) mode, In-Plane Switching (IPS) mode, Fringe Filed Switching (FFS) mode, etc.

In case of the IPS mode, both a pixel electrode and a common electrode are alternately arranged in horizontal direction, whereby a horizontal electric field is generated between the pixel electrode and the common electrode to control an alignment of a liquid crystal layer. In case of the FFS mode, a pixel electrode and a common electrode are provided at a predetermined interval from each other and an insulating layer is interposed between the pixel electrode and the common electrode, whereby a fringe field is generated between the pixel electrode and the common electrode to control an alignment of a liquid crystal layer.

The liquid crystal display device of the IPS mode is processed with a gamma tuning for improving a residual image. The common voltage and a center voltage before gamma tuning will be described with reference to FIG. 1*a*.

FIG. 1*a* is a view illustrating a common voltage (Vcom) and a center voltage (Vcenter) before gamma tuning.

Referring to FIG. 1*a*, a related art liquid crystal display device before gamma tuning uses a common voltage and a gamma voltage. A gamma data of the related art liquid crystal display device includes a positive gamma curve and a negative gamma curve which are symmetrical to each other with respect to the common voltage. The gamma voltage is generated by using the gamma data. The common voltage has the same voltage level as that of the center voltage of the positive gamma curve and the negative gamma curve. Therefore, the center of the gamma voltage is identical to the center voltage (Vcenter). The term "center voltage" may be referred to as the center voltage of the positive gamma curve and the negative gamma curve for each gray level (e.g., G0 to G255 in case of 8 bits and 255-gray).

In other words, the positive gamma curve and the negative gamma curve may be symmetrical for each gray level with respect to the center voltage (Vcenter) which is identical to the common voltage. Therefore, the common voltage of the related art liquid crystal display device is identical to the center voltage (Vcenter), and has a certain voltage level according to the gray level.

In addition, the positive gamma curve and the negative gamma curve are alternatively applied to a pixel array for polarity inversion of the pixel array for each frame to prevent damage on the liquid crystal layer of the related art liquid crystal panel. In theory, when the positive gamma curve and the negative gamma curve are symmetrical to each other with respect to the common voltage, flicker and the residual image may be minimized. For example, in gray level G0, the positive gamma curve is 4.5V and the negative gamma curve is 3.5V. Therefore, with respect to the common voltage, the positive gamma curve has 0.5V potential difference. And, with respect to the common voltage, the negative gamma curve has 0.5V potential difference. Therefore, the potential differences of the positive gamma curve and the negative gamma curve are the same.

However, in the real driving environment, there is a problem of flicker and residual image phenomenon because of the various reasons such as electrical resistance, parasitic capacitance and thermal stress of the liquid crystal panel when the common voltage is identical to the center voltage.

Before gamma tuning, due to the above various reasons, the desired optimal common voltage (Optimal Vcom) for each gray level of the related art liquid crystal display device is analyzed as non-uniform. That is, each gray level requires different optimal voltages to minimize the flicker and residual image problem. However, the related art liquid display device can use only one common voltage as the common electrode is commonly connected with the pixel array. Therefore, even though the non-uniform optimal common voltages (Optimal Vcom) for each gray level are evaluated, the non-uniform optimal common voltages cannot be applied to the related art liquid crystal display device. Thus, the image quality is deteriorated.

DISCLOSURE

Technical Problem

Accordingly, the present invention is directed to a liquid crystal display device and a method for driving the same that substantially obviates one or more problems due to limitations and disadvantages of the related art. An object of the present invention is directed to provide a liquid crystal display device which is capable of reducing or suppressing a residual image problem for both an initial state and a stable state by alternatively applying an optimal common voltage and an optimal gamma voltage in accordance with an operation time, and a method for driving the same.

Another object of the present invention is directed to provide a liquid crystal display device which is capable of reducing a manufacturing cost and improving a manufacturing efficiency by alternatively applying an optimal common voltage and an optimal gamma voltage in accordance with an operation time, and a method for driving the same.

In addition to the aforementioned technical objects, additional features and advantages of the invention will be set forth in part in the description which follows and in part will become apparent to those having ordinary skill in the art upon examination of the following or may be learned from practice of embodiments of the invention.

Technical Solution

To achieve the aforementioned technical objects, a liquid crystal display panel according to the embodiment of the present invention comprises a pixel array configured to suppress a degree of flicker and a short-term residual image when a first gamma voltage and a first common voltage are received and configured to suppress the degree of flicker and a long-term residual image when a second gamma voltage and a second common voltage are received, wherein the first gamma voltage is received during an initial state and the second gamma voltage is received during a stable state, and the initial state switches to the stable state on a basis of a predetermined switching point, wherein the first gamma voltage is generated by using a first gamma data, which includes a first positive gamma curve and a first negative gamma curve on a basis of a first center voltage, wherein the first positive gamma curve and the first negative gamma curve are symmetrical to each other with respect to the first center voltage, which is non-uniform with respect to all gray levels, wherein the second gamma voltage is generated by using a second gamma data, which includes a second positive gamma curve and a second negative gamma curve on a basis of a second center voltage, wherein the second positive gamma curve and the second negative gamma curve are symmetrical to each other with respect to the second center voltage, which is non-uniform with respect to all gray levels.

In the liquid crystal panel according to the embodiment of the present invention, the first common voltage is determined on a basis of a first deviation data and the second common voltage is determined on a basis of a second deviation data, wherein the first and second deviation data have a degree of deviation at a lower gray level, which is larger than degree of deviation at a higher gray level.

In the liquid crystal panel according to the embodiment of the present invention, the first common voltage is higher than the second common voltage.

In the liquid crystal panel according to the embodiment of the present invention, the first gamma voltage is higher than the second gamma voltage, wherein a voltage potential difference between the first gamma voltage and the second gamma voltage is substantially same at the pixel array.

In the liquid crystal panel according to the embodiment of the present invention, a voltage at a lower gray level of the first center voltage is larger than a voltage at a higher gray level of the first center voltage.

In the liquid crystal panel according to the embodiment of the present invention, a maximum deviation value of the first and second deviation data is equal to 0V or less than 100 mV.

In the liquid crystal panel according to the embodiment of the present invention, a duration of the initial state is based on aging conditions of the liquid crystal display panel, wherein the predetermined switching point is determined with respect to the duration of the initial state, and the degree of flicker, the short-term residual image and the long-term residual image remain substantially unchanged during the initial state and the stable state by control of the first gamma voltage, the first common voltage, the second gamma voltage and the second common voltage.

To achieve the aforementioned technical objects, a liquid crystal display device according to the embodiment of the present invention comprises a timing controller, a voltage generating unit, a data driver, and a liquid crystal panel. The timing controller may generate a voltage control signal to switch from an initial state to a stable state by using a predetermined switching point. The voltage generating unit may receive the voltage control signal, supply a first gamma voltage and a first common voltage during the initial state, and supply a second gamma voltage and a second common voltage during the stable state. The data driver may receive the first gamma voltage during the initial state and receive the second gamma voltage during the stable state. The liquid crystal panel may suppress a short-term residual image when the first gamma voltage and the first common voltage are applied and suppress a long-term residual image when the second gamma voltage and the second common voltage are applied.

In the liquid crystal display device according to the embodiment of the present invention, the voltage generating unit includes at least a first bank capable of storing a first gamma data and a first common voltage data and a second bank capable of storing a second gamma data and a second common voltage data, wherein the first gamma voltage is generated on a basis of the first gamma data and the second gamma voltage is generated on a basis of the second gamma data.

The liquid crystal panel according to the embodiment of the present invention further comprises a third bank, wherein the timing controller may generate the voltage control signal to switch from the initial state to an intermediate state by using a first predetermined switching point then switch from the intermediate state to the stable state by using a second predetermined switching point, wherein the voltage generating unit may supply a third gamma voltage and a third common voltage during the intermediate state, wherein the third bank may store a third gamma data and the third common voltage, wherein the third gamma voltage may be generated on the basis of the third gamma data, and the third common voltage may be generated on the basis of the third common voltage data.

In the liquid crystal panel according to the embodiment of the present invention, the first common voltage is uniform to all gray levels, wherein the first gamma data includes a first positive gamma curve and a first negative gamma curve, wherein the first positive gamma curve and the first negative gamma curve are asymmetrical to each other with respect to the first common voltage.

In the liquid crystal panel according to the embodiment of the present invention, the second common voltage is uniform to all gray levels, wherein the second gamma data includes a second positive gamma curve and a second negative gamma curve, wherein the second positive gamma curve and the second negative gamma curve are asymmetrical to each other with respect to the second common voltage.

In the liquid crystal panel according to the embodiment of the present invention, the first common voltage and the second common voltage are different from each other and the first gamma data and the second gamma data are different from each other.

In the liquid crystal panel according to the embodiment of the present invention, the switching point is determined with respect to operation time of the liquid crystal panel.

To achieve the aforementioned technical objects, a method for driving a liquid crystal display device according to the embodiment of the present invention comprises generating, by a timing controller, a voltage control signal to switch from an initial state to a stable state by using a predetermined switching point; receiving, by a voltage generating unit, the voltage control signal, and supplying a first gamma voltage and a first common voltage during the initial state, and supplying a second gamma voltage and a second common voltage during the stable state; receiving, by a data driver, the first gamma voltage during the initial state and receiving the second gamma voltage during the stable state; and suppressing, by a liquid crystal panel including a pixel array, a short-term residual image when the first gamma voltage and the first common voltage are applied and suppressing a long-term residual image when the second gamma voltage and the second common voltage are applied.

Advantageous Effects

According to the liquid crystal display device and the method for driving the same of the present invention, a common voltage and a gamma voltage may be adjusted on the basis of an operation time to reduce or remove a residual image of an initial state.

According to the liquid crystal display device and the method for driving the same of the present invention, a common voltage and a gamma voltage may be adjusted on the basis of an operation time to reduce or remove a residual image of a stable state.

According to the liquid crystal display device and the method for driving the same of the present invention, a common voltage and a gamma voltage may be adjusted on the basis of an operation time to reduce a final test time including a residual image test, whereby a manufacturing cost or a manufacturing time may be reduced, and the residual image may be reduced to enhance manufacturing efficiency.

In addition, other features and advantages of the present invention may newly be set forth through the embodiments of the present invention.

DESCRIPTION OF DRAWINGS

FIG. 2*b* is a view illustrating properties of a liquid crystal display device according to an example of the present invention when an optimal common voltage and an optimal gamma voltage are adjusted by gamma data supplied for an initial state (short-term driving) and a stable state (long-term driving).

MODE FOR DISCLOSURE

Figure 1A:
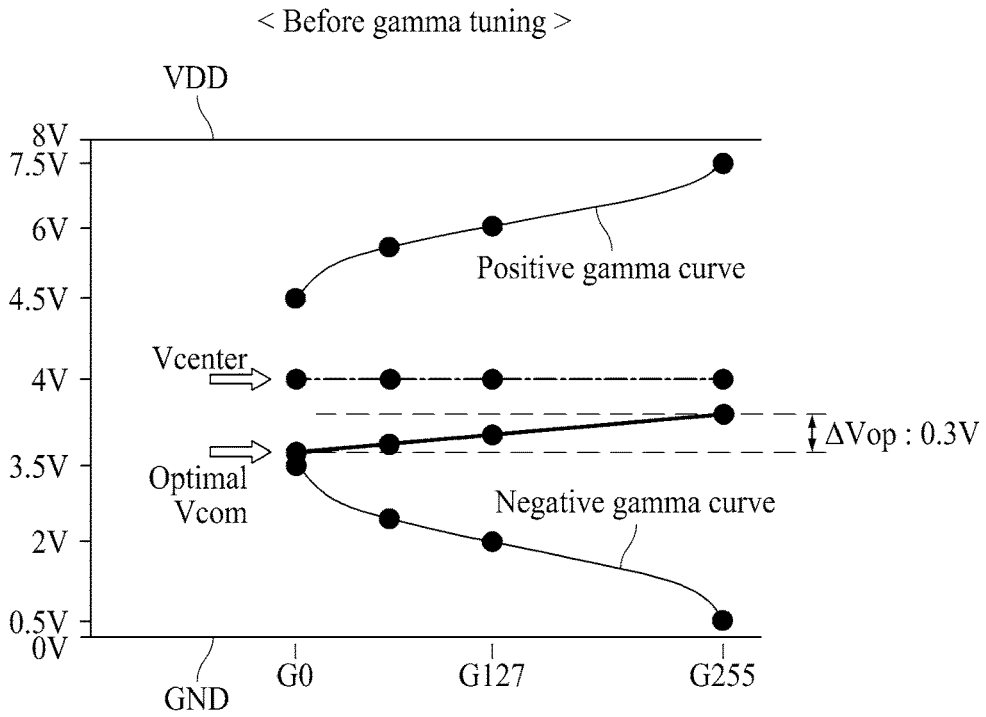
FIG. 1*a* is a view illustrating an optimal common voltage (Vcom) and center voltage (Vcenter) before gamma tuning.

Hereinafter, a liquid crystal display device and a method for driving the same according to the present invention will be described in detail with reference to the accompanying drawings. Wherever possible, the same reference numbers will be used throughout the drawings to refer to the same or like parts. In the following description, if detailed description of elements or functions known in respect of the present invention is determined to make the subject matter of the present invention unnecessarily obscure, the detailed description may be omitted.

Advantages and features of the present invention, and implementation methods thereof will be clarified through following embodiments described with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Further, the present invention is only defined by scopes of claims.

A shape, a size, a ratio, an angle, and a number disclosed in the drawings for describing embodiments of the present invention are merely an example, and thus, the present invention is not limited to the illustrated details. Like reference numerals refer to like elements throughout. In the following description, when the detailed description of the relevant known function or configuration is determined to unnecessarily obscure the important point of the present invention, the detailed description will be omitted. In a case where 'comprise', 'have', and 'include' described in the present specification are used, another part may be added unless 'only~' is used. The terms of a singular form may include plural forms unless referred to the contrary. In construing an element, the element is construed as including an error region although there is no explicit description.

In construing an element, the element is construed as including an error range although there is no explicit description. Features of various embodiments of the present invention may be partially or overall coupled to or combined with each other, and may be variously inter-operated with each other and driven technically as those skilled in the art can sufficiently understand. The embodiments of the present invention may be carried out independently from each other, or may be carried out together in co-dependent relationship.

Figure 1B:
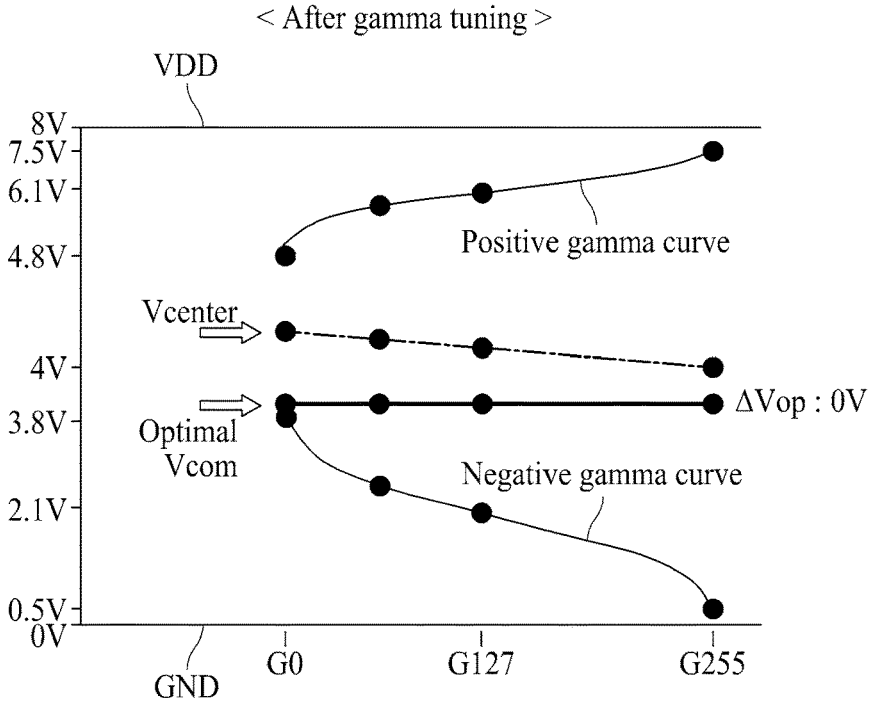
FIG. 1*b* is a view illustrating an optimal common voltage (Vcom) and center voltage (Vcenter) after gamma tuning.

FIG. 1*b* is a view illustrating an optimal common voltage and center voltage after gamma tuning.

Referring to FIG. 1*b*, after gamma tuning, a liquid crystal panel of the IPS mode or the FFS mode according to an embodiment of the present invention is processed with a non-linear (non-uniform) gamma tuning (hereinafter, referred to as "gamma tuning") to reduce a degree of the residual image and a degree of the flicker. The gamma tuning is processed by detecting or analyzing a voltage difference between the optimal common voltage (Optimal Vcom) for each gray level (e.g., G0 to G255) and the center voltage (Vcenter) for each gray level. The optimal common voltage (Optimal Vcom) is a desired common voltage that can reduce a degree of the flicker and a degree of the residual image for each gray level.

By gamma tuning, the center voltage (Vcenter) of each gray level is adjusted such that the optimal common voltage (Optimal Vcom) is uniform for each gray level. As a result, the center voltage (Vcenter) of each gray level becomes non-uniform. In other words, by adjusting the center voltage (Vcenter) from uniform to non-uniform, it is possible to obtain a common voltage which is optimal for all gray levels (e.g., G0 to G255).

A gamma data includes a positive gamma curve and a negative gamma curve. The positive gamma curve and the negative gamma curve are adjusted on the basis of the non-uniform center voltage. The positive gamma curve and the negative gamma curve are symmetrical on the basis of the non-uniform center voltage (Vcenter). The term "symmetrical" can be interpreted to having the same potential difference on the basis of the non-uniform center voltage (Vcenter).

Meanwhile, the positive gamma curve and the negative gamma curve are determined by considering an optimal common voltage for each gray level. Based on the adjusted common voltage (an optimal common voltage which can be commonly applied for all gray levels), the positive gamma curve and the negative gamma curve become asymmetrical to each other.

And, due to the various reasons such as electrical resistance, parasitic capacitance and thermal stress of the liquid crystal panel, the voltage level of the adjusted common voltage could be lower than the voltage level of the non-uniform center voltage (Vcenter).

To adjust the center voltage (Vcenter), an adjusted gamma data (Vop data) is generated.

The term "adjusted gamma data" may be referred to as an adjustment gamma voltage value data on the basis of the non-uniform center voltage (Vcenter) of each gray level such that the positive gamma curve and the negative gamma curve are adjusted such that the optimal common voltage (Optimal Vcom) is uniform for all gray levels (e.g., G0 to G255). Therefore, the non-uniform center voltage (Vcenter) for each gray level is adjusted with the adjusted gamma data (Vop) for each gray level to make the optimal common voltage (Optimal Vcom) uniform for all gray levels. In other words, the positive gamma curve and the negative gamma curve of the adjusted gamma data (Vop data) are adjusted on the basis of the adjusted non-uniform center voltage (Vcenter). Therefore, the optimal gamma voltage is generated with the adjusted gamma data (Vop data) that includes the positive gamma curve and the adjusted negative gamma curve.

If the optimal common voltage (Optimal Vcom) for all gray levels (e.g., G0 to G255) is uniform, flicker can be minimized for all gray levels, and furthermore the degree of the residual image can be reduced for all gray levels. Therefore, the adjusted common voltage needs to be substantially the same as the optimal common voltage or to be close to the optimal common voltage if possible.

The characteristics of the liquid crystal panel may vary under its aging conditions. For example, the aging conditions may be conditions for displaying an image as a backlight is driven at a room temperature (for example, 20° C. to 30° C.) and a random test pattern is supplied to the liquid crystal panel. For example, when the liquid crystal display device that includes the liquid crystal panel is driven, the electrical characteristics and/or physical characteristics of the liquid crystal display device can vary on the basis of the operation time. To be more specific, the electrical stress or thermal stress of the liquid crystal display device can vary. Therefore, the optimal common voltage for each gray level (e.g., G0 to G255) varies on the basis of the operation time. That is, a degree of the flicker and a degree of the residual image may vary on the basis of the operation time. Thus, the image quality of the liquid crystal display device can be changed at a certain operation time period if the common voltage and the gamma voltage are fixed without concerning the aging conditions of the liquid crystal display device.

Figure 2A:
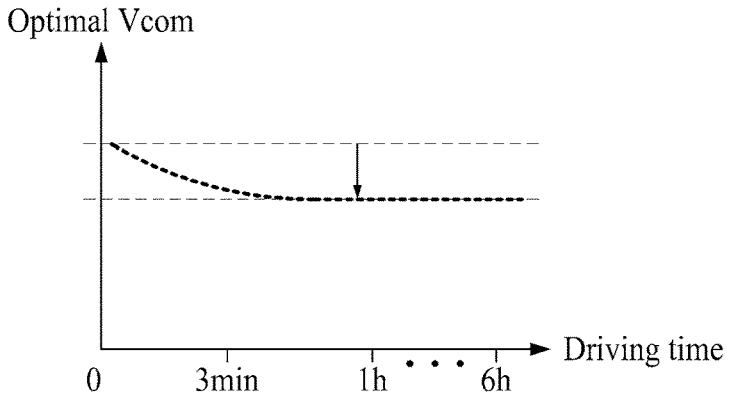
FIG. 2*a* is a view illustrating the change of the optimal common voltage in accordance with the lapse of the operation time of a liquid crystal display device that includes a liquid crystal panel.

FIG. 2*a* is a view illustrating the change of the optimal common voltage in accordance with the operation time of a liquid crystal display device that includes a liquid crystal panel.

Referring to FIG. 2*a*, the optimal common voltage when the liquid crystal panel is in initial state and the optimal common voltage when the liquid crystal panel is in stable state are different from each other. Specifically, the optimal common voltage when the liquid crystal panel is in stable state is smaller than the optimal common voltage when the liquid crystal panel is in initial state. As the optimal common voltage changes depending on the operation time of the liquid crystal panel, the gamma voltage and the common voltage which are optimized in initial state are needed, and the gamma voltage and the common voltage which are optimized in stable state are needed, to reflect the change of the optimal common voltage.

Figure 2B:
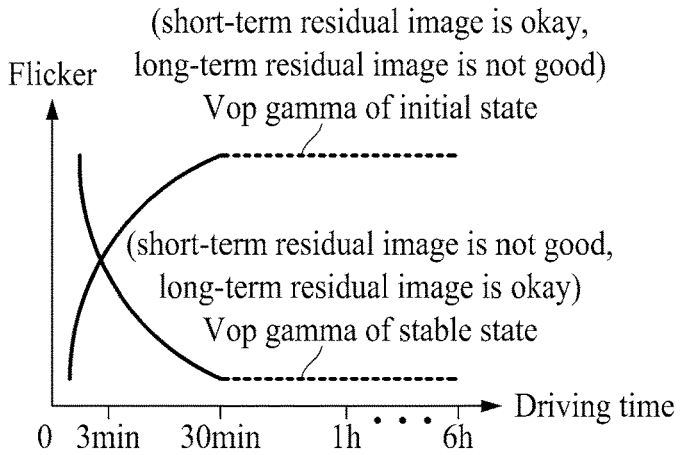
FIG. 2*b* is a view illustrating problems occurring when a common voltage (Vcom) and a gamma data (Vop data) are set to fixed values at an initial state and a stable state.
Figure 2B:
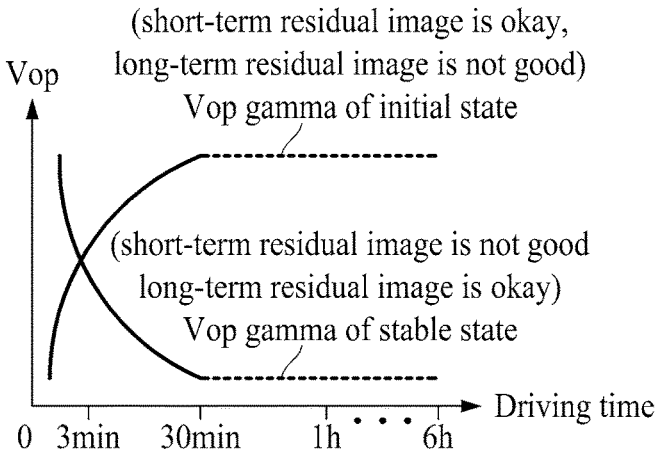

FIG. 2*b* illustrates characteristics of the liquid crystal display device that includes a liquid crystal panel according to an embodiment of the present invention when an optimal common voltage and an optimal gamma voltage which are adjusted by an adjusted gamma data (Vop) are applied for both an initial state (short-term operation) and a stable state (long-term operation).

Referring to FIG. 2*b*, an initial state commences after the liquid crystal display device according to an embodiment of the present invention is turned-on. The initial state lasts for a time period. A stable state commences after the end point of the initial state. As described above, the aging conditions may vary with the operation time. Thus, the optimal common voltage and the optimal gamma voltage may vary on the basis of the operation time.

The stable state starts after a time period. For example, the stable state starts at about 30 minutes after the initial state has started (e.g., 30 minutes after the liquid crystal display device is turned-on). Therefore, a time period for the initial state may be about 30 minutes. However, this time period of the initial state may vary in accordance with various kinds of the liquid crystal display device that includes a liquid crystal panel, and the present invention is not limited thereto.

For example, the optimal common voltage and the optimal gamma voltage for both the initial state and the stable state may be determined on the basis of the stable state. In this case, the optimal common voltage and the optimal gamma voltage are not suitable for the initial state. That is, the optimal common voltage and the optimal gamma voltage, which are optimized for the stable state, are suitable for minimizing the degree of the long-term residual image. Therefore, a problem occurs in that the degree of the short-term residual image is increased during the initial state.

For example, the optimal common voltage and the optimal gamma voltage, which are optimized for both the initial state and the stable state, may be determined on the basis of the initial state. In this case, the optimal common voltage and the optimal gamma voltage are not suitable for the stable state. That is, the optimal common voltage and the optimal gamma voltage optimized for the initial state are suitable for minimizing the degree of the short-term residual image.

However, a problem occurs in that the degree of the long-term residual image is increased during the stable state.

Consequently, due to the difference of the aging conditions of the liquid crystal display device that includes a liquid crystal panel, the optimal common voltage and the optimal gamma voltage for the initial state and the stable state are different from each other. Therefore, it is difficult to suppress both a short-term residual image and a long-term residual image with a fixed optimal common voltage and a fixed optimal gamma voltage. Also, since the optimal common voltage and the optimal gamma voltage for the initial state and the stable state are different from each other, if the optimal common voltage is only adjusted at the initial state and the stable state, it is difficult to suppress both a short-term residual image and a long-term residual image. Also, since the optimal common voltage and the optimal gamma voltage for the initial state and the stable state are different from each other, if the optimal gamma voltage is only adjusted at the initial state and the stable state, it is difficult to suppress both a short-term residual image and a long-term residual image.

Figure 3A:
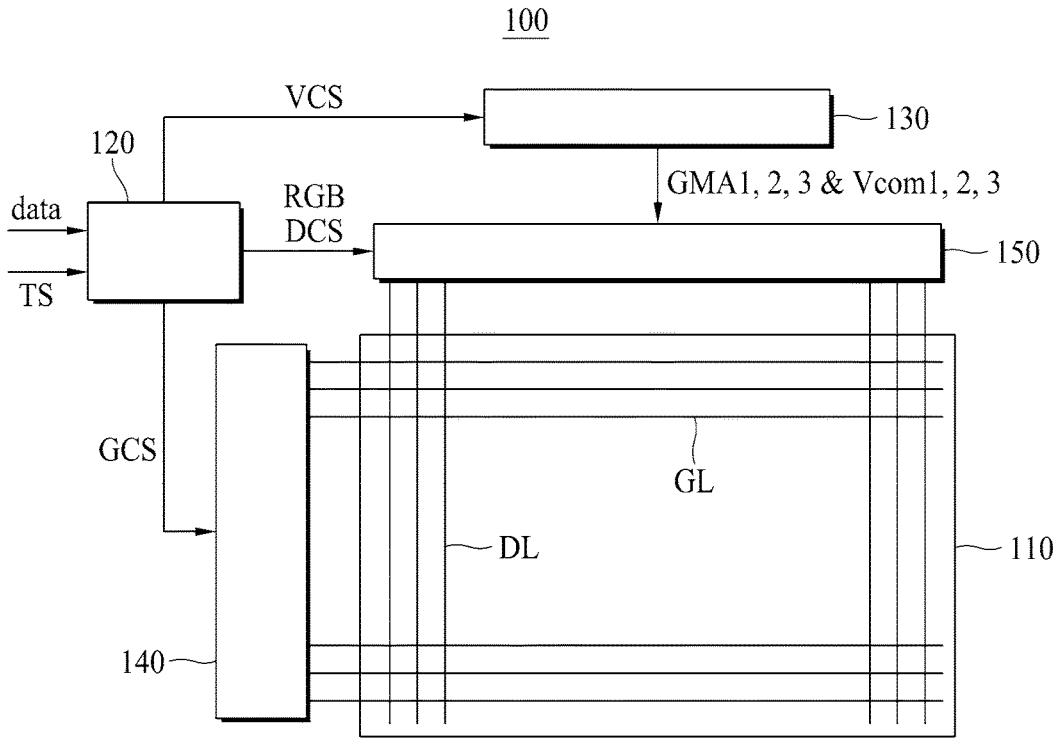
FIG. 3*a* is a view briefly illustrating a liquid crystal display device according to an embodiment of the present invention.

FIG. 3*a* is a view briefly illustrating a liquid crystal display device that includes a liquid crystal panel according to an embodiment of the present invention.

Referring to FIG. 3*a*, the liquid crystal display device 100 according to an embodiment of the present invention includes a liquid crystal panel 110, a timing controller 120, a voltage generating unit 130, a data driver 150, a gate driver 140, a backlight unit for supplying light to the liquid crystal panel 110, a backlight driver for driving a light source, and a power supply part.

The liquid crystal panel 110 displays an image in accordance with a video signal (data) which is input, wherein the liquid crystal panel 110 includes a plurality of gate lines (GL) and a plurality of data lines (DL). Also, the liquid crystal panel 110 includes a plurality of pixels which are formed every region defined by intersections of the plurality of gate lines (GL) and the plurality of data lines (DL). Alternatively, the plurality of pixels may be configured even by sharing of the gate lines (GL) or the data line (DL). In each pixel, there are a pixel electrode and a common electrode. Also, a thin film transistor (TFT) which functions as a switching device is formed in each pixel.

The timing controller 120 aligns the video signal (data) supplied from the external component, converts the aligned video signal into digital video data (R, G, B) of frame unit, and supplies the digital video data to the data driver 150.

Also, the timing controller 120 generates a gate control signal (GCS) for controlling the gate driver 140 and a data control signal (DCS) for controlling the data driver 150 by the use of vertical synchronous signal (Vsync), horizontal synchronous signal (Hsync), and clock signal (CLK) input from the external component. The gate control signal (GCS) is supplied to the gate driver 140, and the data control signal (DCS) is supplied to the data driver 150.

The data control signal (DCS) may include source start pulse (SSP), source sampling clock (SSC), source output enable (SOE), and polarity control (POL) signals. The gate control signal (GCS) may include gate start pulse (GSP), gate shift clock (GSC), and gate output enable (GOE) signals.

Also, the timing controller 120 generates a voltage control signal (VCS) for changing a common voltage and a gamma voltage on the basis of the operation time of the liquid crystal display device, and supplies the voltage control signal (VCS) to the voltage generating unit 130. Hereinafter, the common voltage and the gamma voltage are assumed as the optimal common voltage and the optimal gamma voltage by gamma tuning.

The voltage generating unit 130 is, for example, formed of a programmable gamma IC (P-gamma IC), and can be a power supply IC, a DC-DC converter, buck converter, and/or an integrated power IC. The voltage generating unit 130 includes a look-up table in which gamma data (a gamma voltage including positive and negative gamma curve characteristics) is stored, and a digital-to-analog converter (DAC) for converting the gamma data into a gamma voltage.

Also, the voltage generating unit 130 generates a first gamma voltage (GMA1) which is the adjusted gamma voltage optimized for an initial state, on the basis of the operation time. The voltage generating unit 130 generates a second gamma voltage (GMA2) which is the adjusted gamma voltage optimized for a stable state on the basis of the operation time. The voltage generating unit 130 supplies the first gamma voltage (GMA1) and the second gamma voltage (GMA2) to the data driver 150.

The voltage generating unit 130 generates a first common voltage (Vcom1) optimized for an initial state, on the basis of the operation time. The voltage generating unit 130 generates a second common voltage (Vcom2) optimized for a stable state on the basis of the operation time. That is, the first common voltage (Vcom1) is the adjusted common voltage optimized for the initial state. The second common voltage (Vcom2) is the adjusted common voltage optimized for the stable state. The voltage generating unit 130 supplies the first common voltage (Vcom1) and the second common voltage (Vcom2) to the data driver 150.

The liquid crystal panel 110 may receive the first common voltage (Vcom1) during the initial state and the second common voltage (Vcom2) during the stable state.

The first common voltage (Vcom1) is the adjusted common voltage optimized for the initial state, and the second common voltage (Vcom2) is the adjusted common voltage optimized for the stable state. In this case the adjusted common voltage is characterized such that the voltage level of the first common voltage (Vcom1) is higher than the voltage level of the second common voltage (Vcom2). The third gamma voltage (GMA3) and the third common voltage (Vcom3), which are shown in FIG. 3*a*, would be described with respect to FIG. 12. Also, even though there are at least three gamma voltages and three common voltages in FIG. 3*a*, it is also possible to use only two gamma voltages and two common voltages.

Figure 3B:
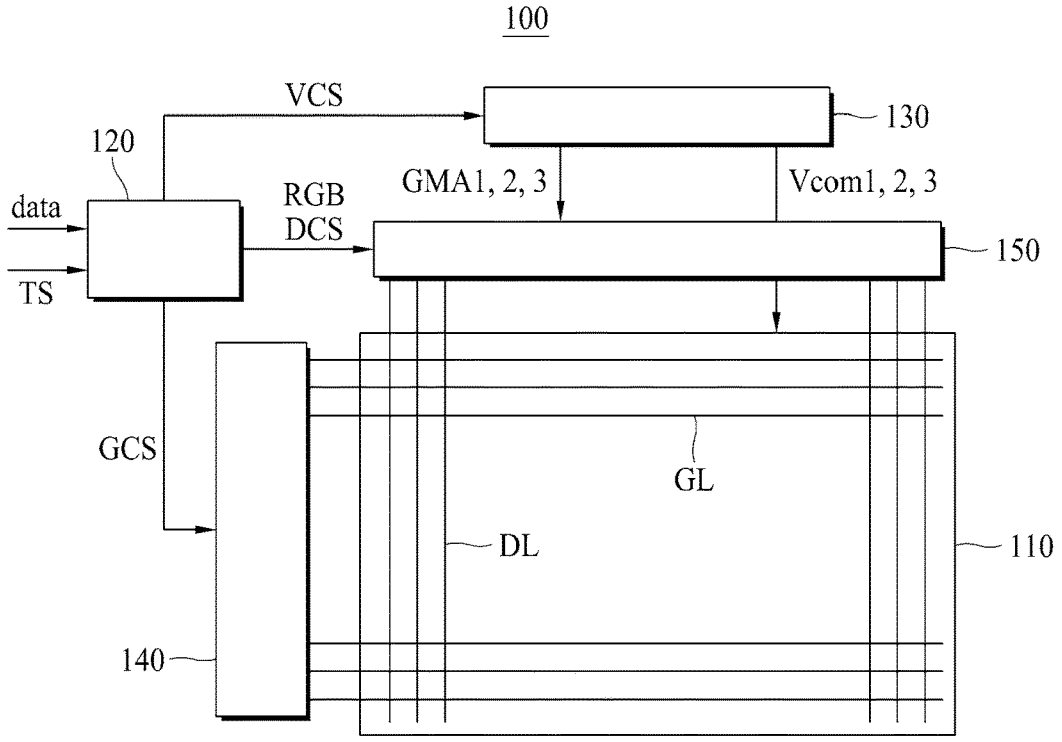
FIG. 3*b* is a view briefly illustrating a liquid crystal display device according to other embodiment of the present invention.

FIG. 3*b* is a view briefly illustrating a liquid crystal display device according to other embodiment of the present invention.

Referring to FIG. 3*b*, the voltage generating unit 130 generates a first gamma voltage (GMA1) which is the adjusted gamma voltage optimized for an initial state, and generates a second gamma voltage (GMA2) which is the adjusted gamma voltage optimized for a stable state, on the basis of the operation time. The voltage generating unit 130 supplies the first gamma voltage (GMA1) and the second gamma voltage (GMA2) to the data driver 150 on the basis of the operation time.

The voltage generating unit 130 generates a first common voltage (Vcom1) optimized for an initial state and a second common voltage (Vcom2) optimized for a stable state on the basis of the operation time. The voltage generating unit 130 selectively supplies the first common voltage (Vcom1) and the second common voltage (Vcom2) to the liquid crystal panel 110.

The liquid crystal panel 110 may receive the first common voltage (Vcom1) during the initial state, and may receive the second common voltage (Vcom2) during the stable state.

The first common voltage (Vcom1) is the adjusted common voltage optimized for the initial state and the second common voltage (Vcom2) is the adjusted common voltage optimized for the stable state. In this case, the adjusted common voltage is characterized such that the voltage level of the first common voltage (Vcom1) is higher than the voltage level of the second common voltage (Vcom2).

The third gamma voltage (GMA3) and the third common voltage (Vcom3) shown in FIG. 3*b* would be described with reference to FIG. 12.

When the liquid crystal panel 110 displays an image, gamma tuning is performed to reduce residual image. At this time, the difference between the optimal common voltage (Vcom) to minimize flicker in each gray and the optimal common voltage (Vcom) of the reference gray can be compensated for the center voltage of each gray.

The optimal common voltage in each gray means a common voltage that makes least flicker when changing the common voltage of each gray (e.g., 0~255 gray). And, the center voltage (Vcenter) means the center value between positive gamma and negative gamma with respect to each gray. That is, the positive gamma and the negative gamma are symmetrical to each other with respect to the center voltage.

The first gamma voltage (GMA1) is generated based on the first gamma data (Vop1 data). The first gamma data (Vop1 data) reflects a maximum deviation value of the optimal common voltages to each gray to reduce or minimize residual image in initial state. The second gamma voltage is generated based on the second gamma data (Vop2 data). The second gamma data (Vop2 data) reflects a maximum deviation value of the optimal common voltages to each gray to reduce or minimize residual image in stable state.

The best case is that the deviation value of the optimal common voltages to each gray is 0V. In the present invention, the range of the deviation value of the optimal common voltages to each gray is 0V~100 mV.

A structure and driving method of the timing controller 120 and the voltage generating unit 130 for generating the first common voltage (Vcom1) and the first gamma voltage (GMA1) optimized for the initial sate and the second common voltage (Vcom2) and the second gamma voltage (GMA2) optimized for the stable state will be described with reference to FIGS. 4 to 8.

Subsequently, the gate driver 140 generates a scan signal (gate driving signal) for sequentially driving a thin film transistor (TFT) formed for each pixel on the basis of the gate control signal (GCS) supplied from the timing controller 120. The generated scan signal is sequentially supplied to each of the gate lines (GL) of the liquid crystal panel 110, whereby the plurality of TFTs are sequentially driven in accordance with the scan signal.

The data driver 150 converts digital video data (R, G, B) supplied from the timing controller 120 into an analog data voltage (data signal) by the use of the first gamma voltage (GMA1) or the second gamma voltage (GMA2) supplied from the voltage generating unit 130. Also, the data driver 150 supplies the data voltage to each of the data lines (DL) of the liquid crystal panel 110 on the basis of the data control signal (DCS) supplied from the timing controller 120. The data driver 150 supplies the first common voltage (Vcom1) or the second common voltage (Vcom2) to the common electrode. However, the voltage generating unit 130 may directly supply the first common voltage (Vcom1) or the second common voltage (Vcom2) to the common electrode.

The backlight unit is provided to emit light to the liquid crystal panel 110. The backlight unit may include a plurality of light sources for producing the light, and a plurality of optical members (diffusion sheet, polarizing sheet, light guiding plate or diffusion plate) for improving efficiency of the light produced in the plurality of light sources. The plurality of light sources may be formed of cold cathode fluorescent lamps (CCFL), external electrode fluorescent lamps (EEFLs), or light emitting diodes (LEDs).

Figure 4:
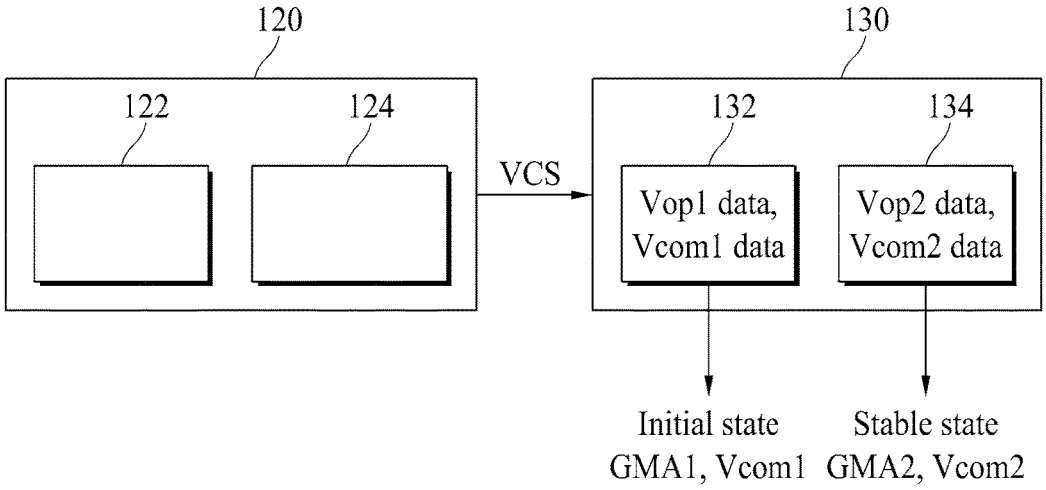
FIG. 4 is a view illustrating a timing controller and a voltage generating unit according to an embodiment of the present invention.

FIG. 4 is a view illustrating the timing controller and the voltage generating unit according to an embodiment of the present invention.

Referring to FIG. 4, the liquid crystal display device 100 according to an embodiment of the present invention simultaneously switches the common voltage and the gamma voltage on the basis of the operation time which is determined in view of the aging conditions of the liquid crystal display device 100. Consequently, the liquid crystal display device 100 is capable of suppressing or minimizing a residual image and flicker for both initial state and the stable state.

The timing controller 120 includes a counter 122 and a common voltage shifter 124.

Also, the voltage generating unit 130 includes a first bank 132 for storing a first gamma data (Vop1 data) and a first common voltage (Vcom1) (optimized for the initial state) for the initial state and a second bank 134 for storing a second gamma data (Vop2 data) and a second common voltage (Vcom2) (optimized for the stable state) for the stable state.

The first common voltage data (Vcom1 data) and the first gamma data (Vop1 data) optimized for the initial state are generated during a manufacturing process of the liquid crystal display device that includes a liquid crystal panel and then are stored in the first bank 132. Also, the second common voltage data (Vcom2 data) and the second gamma data (Vop2 data) optimized for the stable state are generated during the manufacturing process of the liquid crystal display device that includes a liquid crystal panel and then are stored in the second bank 134. Each gamma data is characterized such that the first gamma data (Vop1 data) includes a first positive gamma curve and a first negative gamma curve, and the second gamma data (Vop2 data) includes a second positive gamma curve and a second negative gamma curve.

As the first bank 132 and the second bank 134 are provided inside of the voltage generating unit 130, it is possible to realize rapid switching of the first gamma data (Vop1 data) and the second gamma data (Vop2 data). Especially, since the switching of the first gamma data (Vop1 data) and the second gamma data (Vop2 data) should be done within a frame period (e.g., 16.7 ms), structure of a plurality of banks may be effective for rapid switching. If the switching is not done within one frame period, an image quality may be deteriorated during the switching.

A first gamma tuning is processed. For example, a first deviation data (ΔVop1 data) is determined based on the first common voltage data (Vcom1 data), which is determined by the first gamma data (Vop1 data). To determine the first deviation data (ΔVop1 data), the non-uniform optimal common voltage for each gray level with respect to the uniform center voltage (Vcenter) with respect to the aging conditions of the initial state is evaluated at the state before gamma tuning shown in FIG. 1*a*. As described above, the non-uniform optimal common voltages may be impractical as the liquid crystal display device 100 is configured to supply a common voltage to the common electrode connected to all pixels. The first deviation data (ΔVop1 data) is characterized such that the degree of the deviation at the lower gray level is larger than the degree of the deviation at the higher gray level. At this time, the first deviation data (ΔVop1 data) decides the highest gray level as the reference gray level. But the reference gray level in the present invention is not limited thereto.

The first common voltage (Vcom1 data) which is uniform and optimal for all gray levels (e.g., G0 to G255) is determined with the first deviation data (ΔVop1 data). For example, the first deviation data (ΔVop1 data) for all gray levels may be obtained by calculating the deviation of the desired non-uniform optimal common voltages of all gray levels. In this case, the maximum non-uniform optimal common voltage is used as a reference voltage. The rest of the non-uniform optimal common voltages are adjusted to be the same as the reference voltage. Therefore, the adjusted values are calculated for generating the first deviation data (ΔVop1 data) for each gray level and the adjusted common voltages become uniform, whereby the first common voltage data (Vcom1 data) is determined. But the present invention is not limited to the value of the reference voltage.

The first gamma data (Vop1 data) is determined with the first deviation data (ΔVop1 data) and the first center voltage (Vcenter1). For example, the uniform center voltage is adjusted by the first deviation data (ΔVop1 data), whereby the first center voltage (Vcenter1) is determined. The first center voltage (Vcenter1) is characterized such that the center voltage at the lower gray level is larger than the center voltage at the higher gray level on the basis of the first deviation data (ΔVop1 data). In other words, the first center voltage (Vcenter1) corresponds to the first deviation data (ΔVop1 data).

The positive gamma curve and the negative gamma curve of the first gamma data (Vop1 data) are adjusted on the basis of the first center voltage (Vcenter1).

For example, at the certain gray level, the first center voltage is increased by 100 mV, then both the positive gamma curve and the negative gamma curve of the first gamma data (Vop1 data) at the certain gray level is increased by 100 mV. The first gamma data (Vop1 data) is characterized such that the first positive gamma curve and the first negative gamma curve are symmetrical to each other with respect to the first center voltage (Vcenter1) and the first positive gamma curve and the first negative gamma curve are asymmetrical to each other with respect to the first common voltage (Vcom1), wherein the first center voltage (Vcenter1) is non-uniform for each gray level and the first common voltage (Vcom1) is uniform for each gray level, whereby the flicker and the short-term residual image can be reduced for the initial state.

Additionally, the maximum deviation value of the first deviation data (ΔVop1 data) can be equal to 0V or less than 100 mV. As described above, a maximum deviation value is described as 0V, however, in the real driving environment, it is possible to adjust the maximum deviation value to be higher than 0V. Therefore, at least the maximum deviation value of the first deviation data (ΔVop1 data) is less than 100 mV, and the flicker and the short-term residual image can be sufficiently reduced.

Here, the first positive gamma curve and the first negative gamma curve are symmetrical to each other with respect to the first center voltage (Vcenter1). As the first center voltage (Vcenter1) is the central value of the first positive gamma curve and the first negative gamma curve, the first center voltage (Vcenter1) can be calculated by the first positive gamma curve and the first negative gamma curve. The center voltage does not necessarily be saved as certain data, and if necessary, can be calculated by using the positive gamma curve and the negative gamma curve. But the present invention is not limited thereto, and the data of the first center voltage (Vcenter1) can be stored in memory, and if needed, can be loaded and used.

Subsequently, a second gamma tuning is processed. Regarding the second gamma tuning, redundant features with respect to the first gamma tuning will not be described (merely for the sake of brevity). For example, a second deviation data (ΔVop2 data) is determined based on the second common voltage (Vcom2) that is determined by the second gamma data (Vop2 data). To determine the second deviation data (ΔVop2 data), the non-uniform optimal common voltages for each gray level with respect to the uniform center voltage (Vcenter) with respect to the aging conditions of the stable state are evaluated at the state before gamma tuning shown in FIG. 1*a*. The second deviation data (ΔVop2 data) is characterized such that the degree of the deviation at the lower gray level is larger than the degree of the deviation at the higher gray level on the basis of the desired non-uniform optimal common voltage.

The second common voltage (Vcom2) which is uniform and optimal for all gray levels (e.g., G0 to G255) is determined with the second deviation data (ΔVop2 data).

The second center voltage (Vcenter2) is characterized such that the center voltage at the lower gray level is larger than the center voltage at the higher gray level on the basis of the second deviation data (ΔVop2 data). In other words, the second center voltage (Vcenter2) corresponds to the second deviation data (ΔVop2 data).

The second positive gamma curve and the second negative gamma curve of the second gamma data (Vop2 data) are adjusted on the basis of the second center voltage (Vcenter2). The second gamma data (Vop2 data) is characterized such that the second positive gamma curve and the second negative gamma curve are symmetrical to each other with respect to the second center voltage (Vcenter2) and the second positive gamma curve and the second negative gamma curve are asymmetrical to each other with respect to the second common voltage (Vcom2), wherein the second center voltage (Vcenter2) is non-uniform and the second common voltage (Vcom2) is uniform, whereby the flicker and the long-term residual image can be reduced for the stable state.

Additionally, the maximum deviation value of the second deviation data (ΔVop2 data) can be equal to 0V or less than 100 mV.

Here, the second positive gamma curve and the second negative gamma curve are symmetrical to each other with respect to the second center voltage (Vcenter2). As the second center voltage (Vcenter2) is the central value of the second positive gamma curve and the second negative gamma curve, the second center voltage (Vcenter2) can be calculated by the second positive gamma curve and the second negative gamma curve. The center voltage does not necessarily be saved as certain data, and if necessary, can be calculated by using the positive gamma curve and the negative gamma curve. But the present invention is not limited thereto, and the data of the second center voltage (Vcenter2) can be stored in memory, and if needed, can be loaded and used.

A method for storing the first gamma data (Vop1 data) and the first common voltage data (Vcom1 data) in the first bank 132 and storing the second gamma data (Vop2 data) and the second common voltage data (Vcom2 data) in the second bank 134 will be described with reference to FIGS. 6 and 7.

Figure 5:
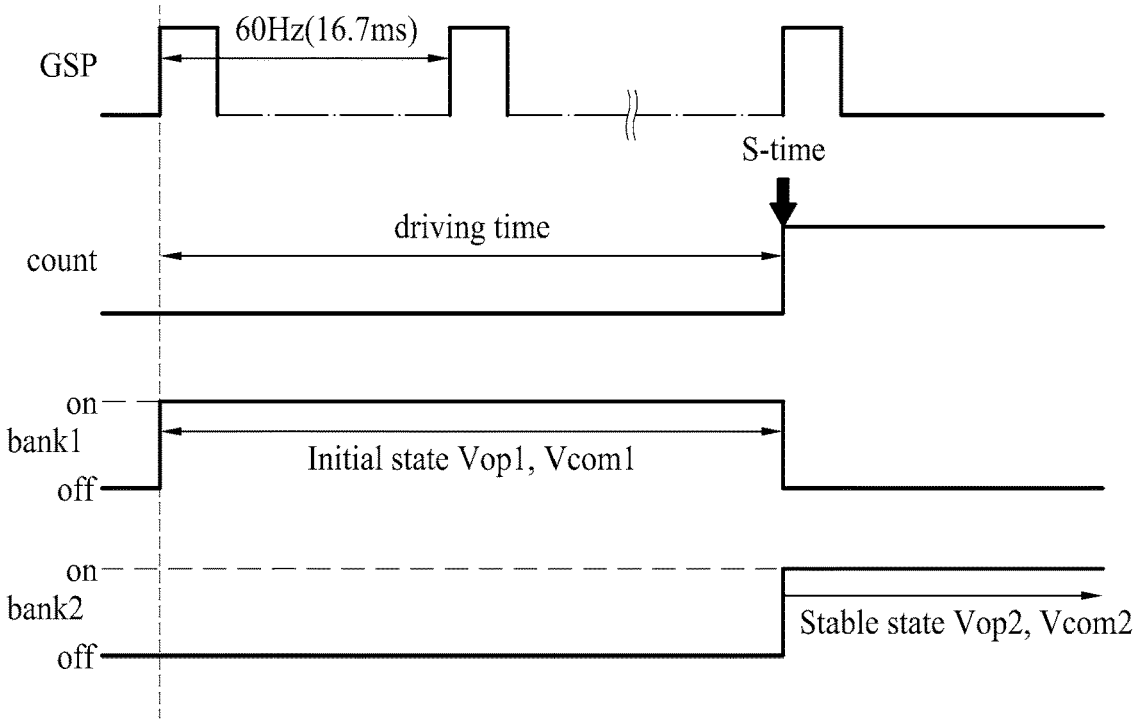
FIG. 5 is a view illustrating a method for changing a gamma voltage and a common voltage in accordance with an initial state and a stable state.

Referring to FIG. 5 in connection with FIG. 4, the timing controller 120 includes the counter 122 that can store a predetermined switching point to switch from the initial state to the stable state. The voltage control signal (VCS) may be generated in the timing controller 120 on the basis of the switching point.

To be specific, the switching point represents operation time information. The switching point from the initial state to the stable state is stored in the counter 122. The counter 122 may start counting from the beginning of the initial state when the liquid crystal display device 100 is turned-on. The counter 122 may identify that the liquid crystal display device 100 is under the stable state after the switching point is passed.

When the counter 122 identifies the switching point of the liquid crystal display device 100, the timing controller 120 generates the voltage control signal (VCS) for controlling the turn-on and turn-off state of the first bank 132 and the second bank 134. The voltage control signal (VCS) generated in the timing controller 120 may be supplied to the voltage generating unit 130.

The voltage control signal (VCS) may be output at the initial state when the liquid crystal display device 100 is turned-on and may be output at the switching point. The voltage control signal (VCS) may control the voltage generating unit 130 to output the first gamma voltage (GMA1) and the first common voltage (Vcom1). Also, the voltage control signal (VCS) may control the voltage generating unit 130 to output the second gamma voltage (GMA2) and the second common voltage (Vcom2). That is, by the voltage control signal (VCS), the first gamma voltage (GMA1) or the second gamma voltage (GMA2) is selectively output. And, by the voltage control signal (VCS), the first common voltage (Vcom1) or the second common voltage (Vcom2) is selectively output.

The voltage generating unit 130 controls the turn-on and turn-off state of the first bank 132 and the second bank 134 on the basis of the voltage control signal (VCS). In the initial state, the first bank 132 is turned-on (activated), and the second bank 134 is turned-off (deactivated). Accordingly, the voltage generating unit 130 generates the first gamma voltage (GMA1) and the first common voltage (Vcom1) on the basis of the first gamma data (Vop1 data) and the first common voltage data (Vcom1 data) stored in the first bank 132. The first gamma voltage (GMA1) and the first common voltage (Vcom1) are output to the data driver 150. In some embodiments, the first common voltage (Vcom1) may be output directly to the liquid crystal panel 110.

In the stable state, the second bank 134 is turned-on, and the first bank 132 is turned-off. Accordingly, the voltage generating unit 130 generates the second gamma voltage (GMA2) and the second common voltage (Vcom2) on the basis of the second gamma data (Vop2 data) and the second common voltage data (Vcom2 data) stored in the second bank 134. The second gamma voltage (GMA2) and the second common voltage (Vcom2) are output to the data driver 150. In some embodiments, the second common voltage (Vcom2) may be output directly to the liquid crystal panel 110.

The common voltage shifter 124 included in the timing controller 120 is configured to be operated during the gamma tuning process. For example, the common voltage shifter 124 is operated when storing the second common voltage data (Vcom2 data) into the second bank 134. However, when the liquid crystal display device 100 is under operation, the common voltage shifter 124 is configured to be idle. This will be described in detail with reference to FIGS. 6 and 7.

As described with reference to FIGS. 4 and 5, in order to output the first common voltage (Vcom1) and the first gamma voltage (GMA1) to the data driver 150 during the initial state, and output the second common voltage (Vcom2) and the second gamma voltage (GMA2) to the data driver 150 during the stable state, the first gamma data (Vop1 data) and the first common voltage data (Vcom1 data) are stored in the first bank 132, and the second gamma data (Vop2 data) and the second common voltage data (Vcom2 data) are stored in the second bank 134.

Hereinafter, a process for generating the first and second common voltages and the first and second gamma voltages will be described with reference to FIGS. 6 and 7.

Figure 6:
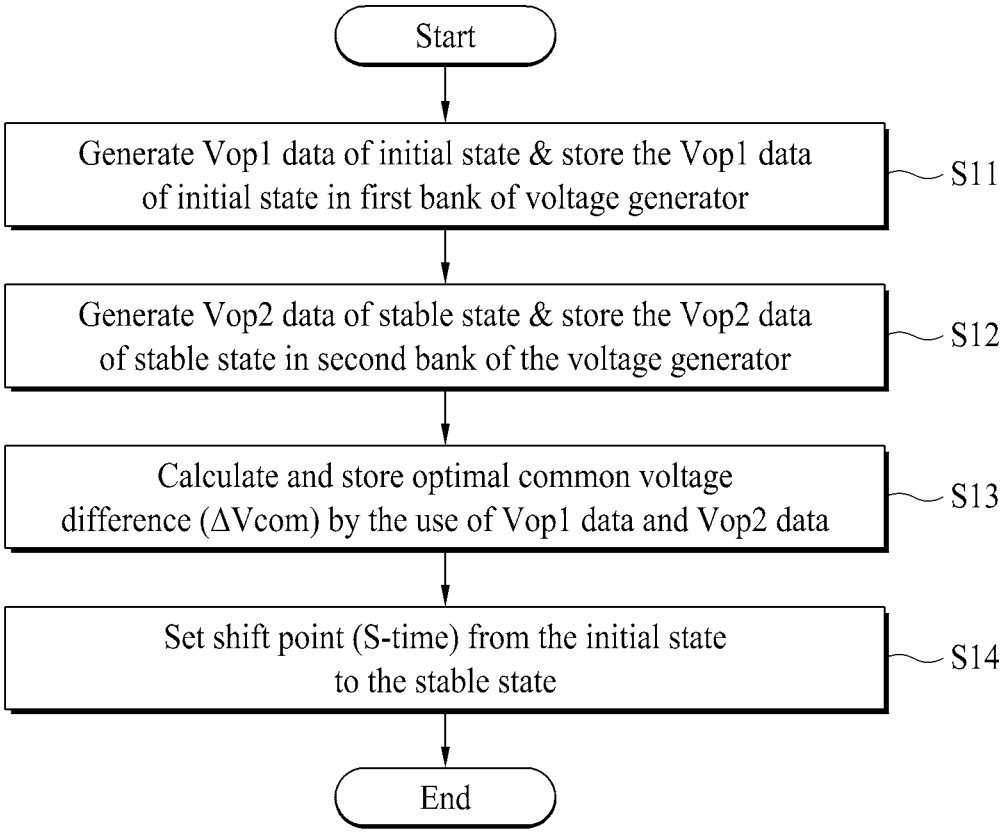
FIGS. 6 to 8 are views illustrating a method for driving the liquid crystal display device according to an embodiment of the present invention.
Figure 7:
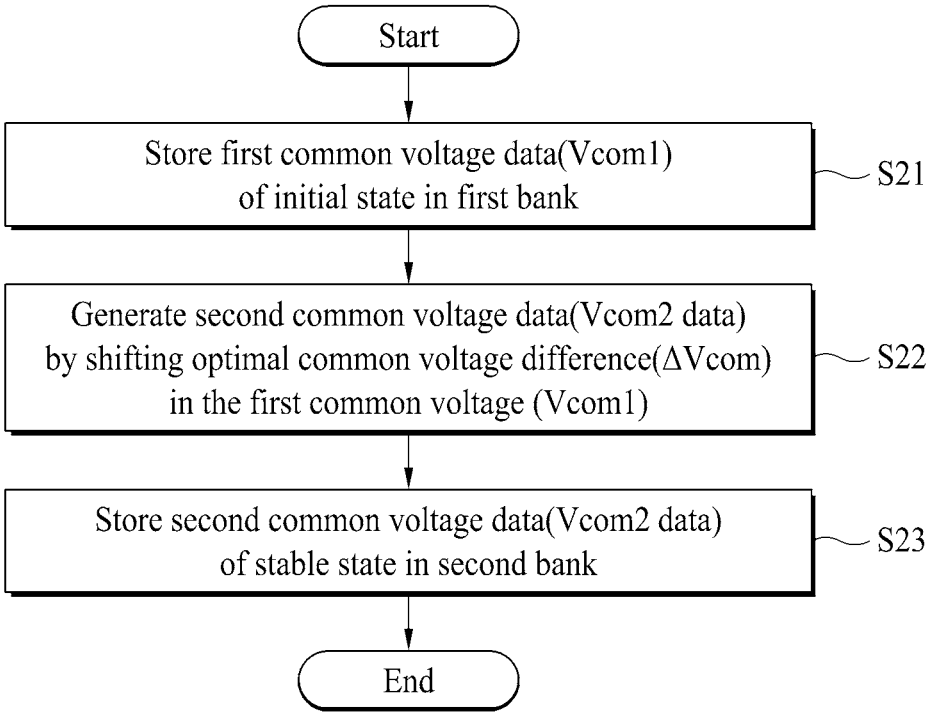

Referring to FIGS. 4 to 6, for the manufacturing process of the liquid crystal display device 100, the first gamma data (Vop1 data) for generating the initial state gamma voltage (first gamma voltage) is generated, and the first gamma data (Vop1 data) is stored in the first bank 132 of the voltage generating unit 130 (S11).

The second gamma data (Vop2 data) for generating the stable state gamma voltage (second gamma voltage) is generated, and the second gamma data (Vop2 data) is stored in the second bank 134 of the voltage generating unit 130 (S12).

Then, a voltage difference (ΔVcom) of the first common voltage (Vcom1) and the second common voltage (Vcom2) is calculated on the basis of the first gamma data (Vop1 data) and the second gamma data (Vop2 data). The voltage difference is stored in the common voltage shifter 124 of the timing controller 120 (S13).

As the counting is started at the beginning of the initial state when the display device is turned-on, the operation time from the initial state to the stable state is measured considering the aging conditions of the liquid crystal panel 110 that includes the liquid crystal panel 110. The switching point (also, referred to as S-time) is stored in the counter 122 of the timing controller 120 (S14).

Subsequently, referring to FIGS. 4 to 7, the first common voltage data (Vcom1 data) optimized for the initial state is determined in a final inspection step of the manufacturing process of the liquid crystal display device 100. In this case, the first common voltage data (Vcom1 data) is stored in the first bank 132 of the voltage generating unit 130 (S21).

The common voltage difference (ΔVcom) is stored in the common voltage shifter 124, and the second common voltage data (Vcom2 data) is generated by applying the common voltage difference (ΔVcom) to the first common voltage data (Vcom1 data) (S22).

Then, the second common voltage data (Vcom2 data) optimized for the stable state is stored in the second bank 134 of the voltage generating unit 130 (S23).

Hereinafter, an example for supplying the first and second gamma voltages and the first and second common voltages for operating the liquid crystal display device 100 will be described in detail.

Figure 8:
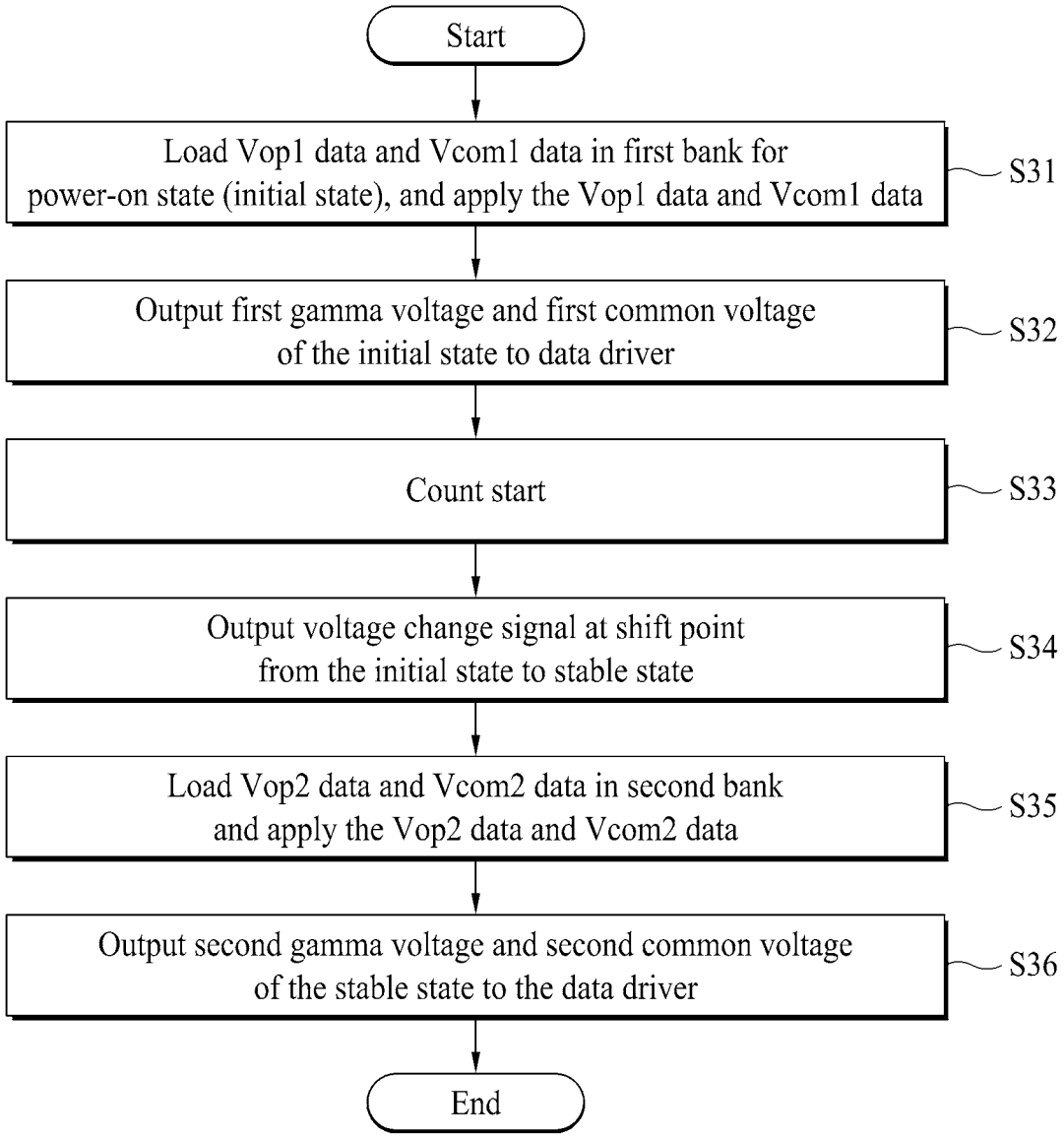

Referring to FIGS. 4 and 8, the liquid crystal display device 100 is turned on to enter the initial state. Therefore, the timing controller 120 activates the first bank 132 of the voltage generating unit 130. In this case, the second bank 134 of the voltage generating unit 130 is deactivated. The first common voltage data (Vcom1 data) and the first gamma data (Vop1 data) stored in the first bank 132 are loaded for generating the first gamma voltage (GMA1) (S31).

Then, the first gamma voltage (GMA1) is generated on the basis of the first gamma data (Vop1 data) and supplied to the data driver 150. Also, the first common voltage (Vcom1) is generated on the basis of the first common voltage data (Vcom1 data) loaded from the first bank 132, and is supplied to the data driver 150 (S32). In other embodiments of the present invention, the first common voltage (Vcom1) may directly be supplied to the liquid crystal panel 110.

The counter 122 starts counting for identifying the switching point from the initial state to the stable state (S33).

The counter 122 identifies that the initial state is switched to the stable state after the switching point has passed. The counter 122 is configured to preset the switching point that is capable of identifying the aging conditions of the liquid crystal display device 100 as being stable on the basis of the elapsed operation time. The counter 122 may count the operation time since the liquid crystal display device 100 is turned-on. The counter 122 identifies that the stable state is commenced after the predetermined operation time has passed.

Based on the switching point from the initial state to the stable state, the timing controller 120 generates the voltage control signal (VCS) for controlling the turning-on/off state of the first bank 132 and the second bank 134 of the voltage generating unit 130, and generates the voltage control signal (VCS). The timing controller 120 outputs the voltage control signal (VCS) to the voltage generating unit 130 (S34).

Based on the voltage control signal (VCS) which is provided from the timing controller 120, the voltage generating unit 130 activates the second bank 134 of the voltage generating unit 130. At this time, the first bank 132 of the voltage generating unit 130 is deactivated. The second common voltage data (Vcom2 data) and the second gamma data (Vop2 data) stored in the second bank 134 are loaded for generating the second gamma voltage (GMA2) (S35).

That is, if the current state of the liquid crystal display device 100 is switched to the stable state after the predetermined operation time, the second gamma data (Vop2 data) is applied to generate the second gamma voltage (GMA2).

The second gamma voltage (GMA2) of the stable state is generated on the basis of the second gamma data (Vop2 data) and supplied to the data driver 150. Also, the second common voltage (Vcom2) is generated on the basis of the second common voltage data (Vcom2 data) loaded in the second bank 134, and is supplied to the data driver 150 (S32). According to other embodiment of the present invention, the second common voltage (Vcom2) may directly be supplied to the liquid crystal panel.

The first common voltage (Vcom1) corresponding to the first gamma voltage (GMA1) and the second common voltage (Vcom2) corresponding to the second gamma voltage (GMA2) are different from each other. However, the substantial potential at the pixel array of the liquid crystal panel 110 is identical during the initial state and the stable state. Accordingly, in the image quality of the liquid crystal display device 100, the image quality during the initial state is substantially the same as the image quality during the stable state. In other words, the liquid crystal display device 100 is capable of displaying the substantially the same gray level regardless of the current state, and a decrease in the image quality can be obviated.

Therefore, the timing controller 120 may provide the optimal common voltages in view of the current conditions of the liquid crystal panel 110 such as the aging conditions. For example, at the beginning of the initial state, the temperature of the liquid crystal panel 110 is colder than the beginning of the stable state such that the response time characteristic of the liquid crystal layer is different at each state. The timing controller 120 may provide a first common voltage (Vcom1) and a first gamma voltage (GMA1) with respect to the initial state, and then the timing controller 120 may provide a second common voltage (Vcom2) and a second gamma voltage (GMA2) with respect to the stable state by the voltage control signal (VCS).

The first common voltage (Vcom1) and the first gamma voltage (GMA1) during the initial state and the second common voltage (Vcom2) and the second gamma voltage (GMA2) can provide the substantially the same degree of the flicker and the substantially the same degree of the residual image. The substantially the same degree of the flicker and the substantially the same degree of the residual image may occur during both the initial state and the stable state. Alternatively, the substantially the same degree of the flicker and the substantially the same degree of the residual image may include that the degree of the residual image and the degree of the flicker are minimized during both the initial state and the stable state. Therefore, regardless of the current state, the high image quality can be maintained during both initial state and the stable state.

For the above description, only two banks (first bank 132 and second bank 134) are provided to store a plurality of the gamma data. However, the present invention is not limited thereto. For example, more than two banks may be provided for storing a plurality of the gamma data. In this case, different gamma data optimized for the initial state and the stable state may be supplied for generating the gamma voltage optimized for the initial state and the stable state.

Figure 9:
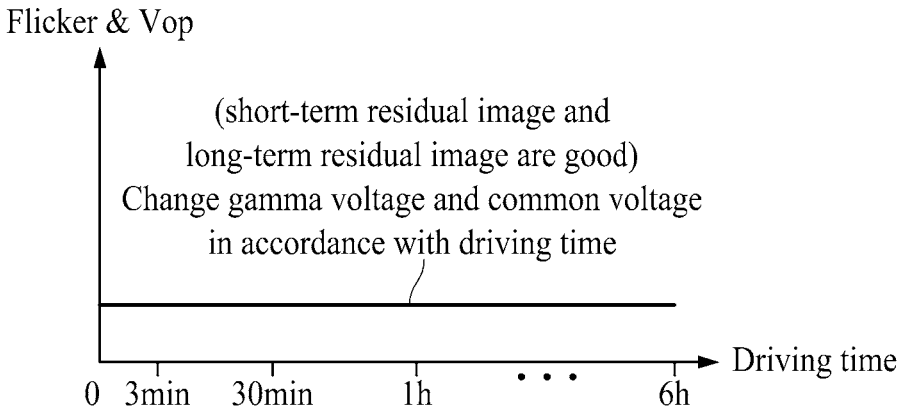
FIG. 9 is a view illustrating improved picture quality when a common voltage and a gamma data optimized for the initial state and the stable state are selectively applied in accordance with an operation time.

FIG. 9 is a view illustrating improved picture quality when the common voltage and the gamma voltage optimized for short-term state (initial state) and long-term state (stable state) are selectively applied on the basis of the operation time.

Referring to FIG. 9, the first common voltage (Vcom1) and the first gamma voltage (GMA1) optimized for the initial state are generated on the basis of the elapsed operation time of the liquid crystal display device 100, and the second common voltage (Vcom2) and the second gamma voltage (GMA2) optimized for the stable state are generated on the basis of the elapsed operation time of the liquid crystal display device 100. As a result, it is possible to reduce the flicker and the degree of the deviation of the optimal common voltage. Thus, the liquid crystal display device 100 according to an embodiment of the present invention may suppress or reduce a short-term residual image by applying the first common voltage (Vcom1) and the first gamma voltage (GMA1) in the initial state, and may suppress or reduce a long-term residual image by applying the second common voltage (Vcom2) and the second gamma voltage (GMA2) in the stable state.

Figure 10:
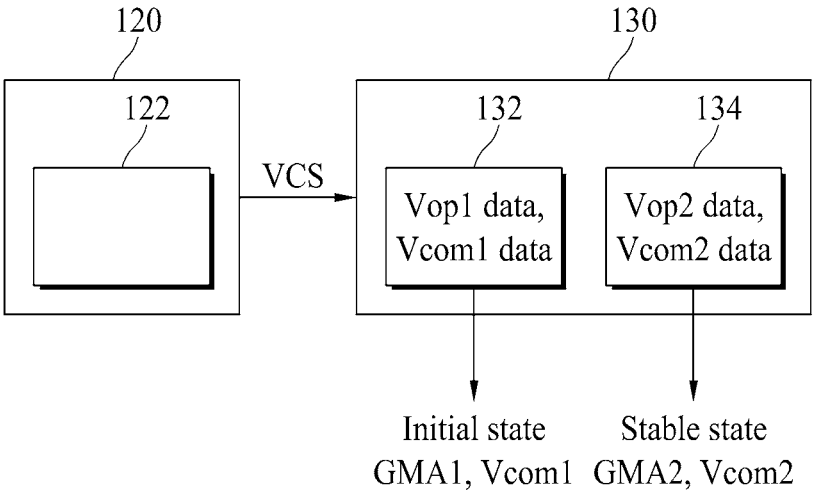
FIG. 10 is a view illustrating a timing controller and a voltage generating unit according to another embodiment of the present invention.

FIG. 10 is a view illustrating a timing controller and a voltage generating unit in a liquid crystal display device according to another embodiment of the present invention.

Referring to FIG. 10, a counter 122 may be provided inside a timing controller 120, and the common voltage shifter 124 shown in FIG. 4 may be removed from the timing controller 120. In the step of setting the common voltage, which is shown in FIG. 7, the common voltage shifter 124 calculates the common voltage difference (ΔVcom) between the common voltage (Vcom1) and the second common voltage (Vcom2), and thus generates the second common voltage (Vcom2) by the use of the common voltage difference (ΔVcom). Thus, there is no need to provide the common voltage shifter 124 inside of the timing controller 120. For setting the first and the second common voltages, the common voltage shifter 124 may be provided in a manufacturing apparatus. That is, the second common voltage (Vcom2) may be generated by the use of the common voltage shifter 124 provided in the manufacturing apparatus, and then the second common voltage data (Vcom2 data) may be stored in the second bank 134.

Figure 11:
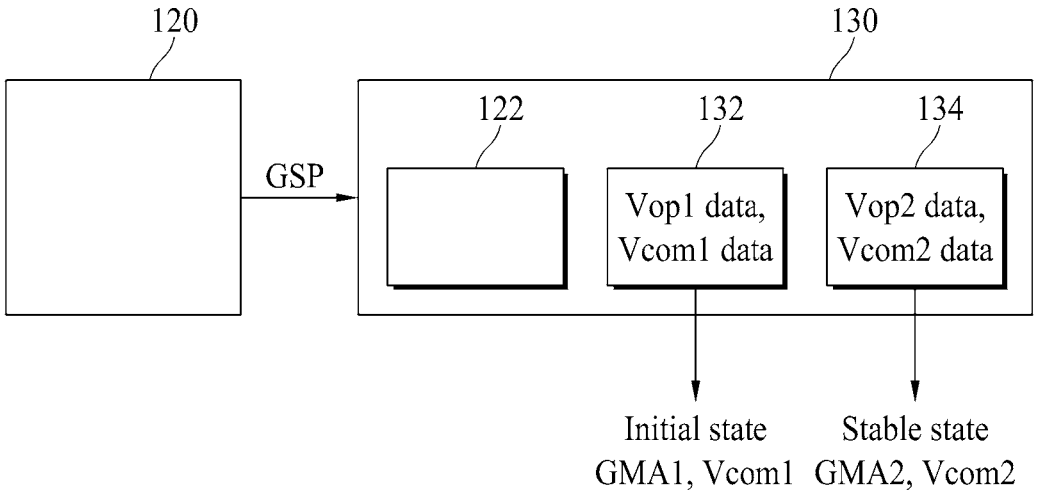
FIG. 11 is a view illustrating a timing controller and a voltage generating unit according to another embodiment of the present invention.

FIG. 11 is a view illustrating a timing controller and a voltage generating unit in a liquid crystal display device according to yet another embodiment of the present invention.

Referring to FIG. 11, a counter 122 may be provided inside a voltage generating unit 130. As shown in FIG. 8, the counter 122 identifies the switching point from the initial state to the stable state. That is, the counter 122 identifies that the liquid crystal display device is in the stable state with elapsed operation time preset in the initial state. The counter 122 may be provided in the voltage generating unit 130. Instead of being provided inside of the timing controller 120 or the voltage generating unit 130, the counter 122 may be separately provided as an independent unit.

Figure 12:
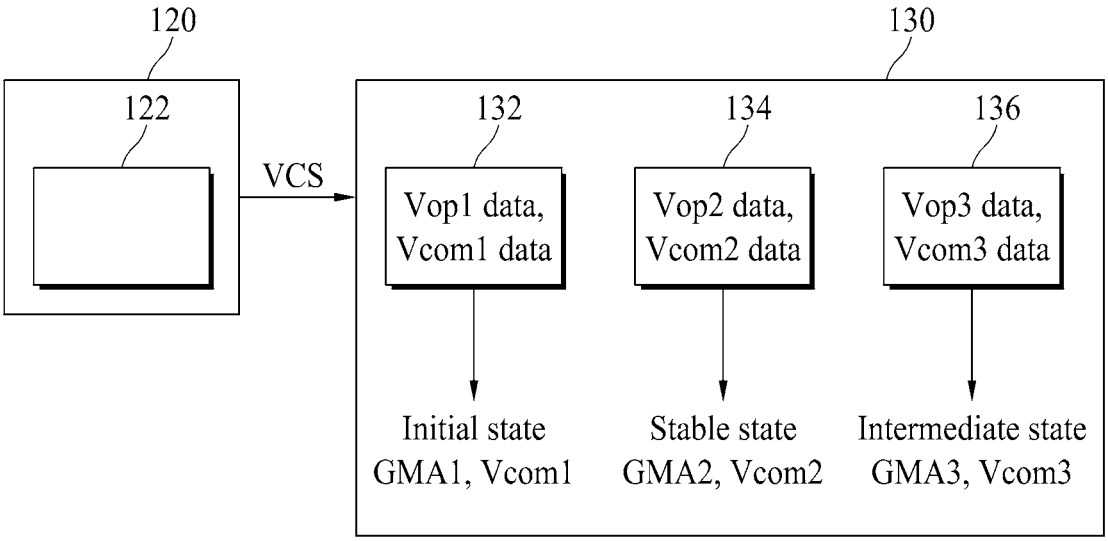
FIG. 12 is a view illustrating a timing controller and a voltage generating unit according to another embodiment of the present invention, and a driving method thereof.

FIG. 12 is a view illustrating a timing controller and a voltage generating unit in an LCD device according to another embodiment of the present invention, and a driving method thereof.

Referring to FIG. 12, in case of a liquid crystal display device 100 according to another embodiment of the present invention, a common voltage and a gamma voltage are adjusted according to the operation time determined based on the aging conditions of a liquid crystal panel 110, to thereby reduce residual images and flicker.

A timing controller 120 includes a counter 122. A voltage generating unit 130 includes a plurality of banks. For example, the first common voltage data (Vcom1 data) and the first gamma data (Vop1 data) of the initial state are stored in a first bank 132. The second common voltage data (Vcom2 data) and the second gamma data (Vop2 data) of the stable state are stored in a second bank 134. The third common voltage data (Vcom3 data) and the third gamma data (Vop3 data) of intermediate state are stored in a third bank 136.

The counter 122 of the timing controller 120 starts counting at the initial state and identifies the intermediate state with the predetermined switching point. Then, the counter 122 generates a voltage control signal (VCS) in accordance with the intermediate state, and outputs the generated voltage control signal (VCS). In this case, the operation time for switching from the initial state to the intermediate state is determined and stored in the counter 122.

If the counter 122 identifies that the liquid crystal display device 100 is in the intermediate state, the timing controller 120 generates the voltage control signal (VCS) for controlling turning-on/off state of the first bank 132, the second bank 134 and the third bank 136. The voltage control signal (VCS) for generating the common voltage and the gamma voltage optimized for the intermediate state generated in the timing controller 120 are supplied to the voltage generating unit 130.

If the voltage control signal (VCS) for the intermediate state is input to the voltage generating unit 130, the third common voltage (Vcom3) and third gamma voltage (GMA3) are supplied to the liquid crystal panel 110 in accordance with the voltage control signal (VSC).

At this time, the first common voltage data (Vcom1 data) and the first gamma data (Vop1 data) are generated in a manufacturing process and stored in the first bank 132.

Also, the second common voltage data (Vcom2 data) and the second gamma data (Vop2 data) are generated in the manufacturing process and stored in the second bank 134.

Also, the third common voltage (Vcom3 data) and the third gamma data (Vop3 data) are generated in the manufacturing process and stored in the third bank 136.

The first gamma data (Vop1 data) is stored in the first bank 132 for generating the first gamma voltage (GMA1) of the initial state, the second gamma data (Vop2 data) is stored in the second bank 134 for generating the second gamma voltage (GMA2) of the stable state, and the third gamma data (Vop3 data) is stored in the third bank 136 for generating the third gamma voltage (GMA3) of the intermediate state.

The first common voltage data (Vcom1 data) is stored in the first bank 132 for generating the first common voltage (Vcom1) of the initial state, the second common voltage data (Vcom2 data) is stored in the second bank 134 for generating the second common voltage (Vcom2) of the stable state, and the third common voltage data (Vcom3 data) is stored in the third bank 136 for generating the third common voltage (Vcom3) of the intermediate state.

In this case, the intermediate state is between the initial state and the stable state. Herein, the intermediate state denotes that the liquid crystal panel 110 is in the state before approaching the stable state after the initial state. The aging conditions of the liquid crystal panel 110 are continuously changed until the stable state. Therefore, the common voltage and the gamma voltage optimized for the intermediate state can be added more.

In the liquid crystal display device 100 according to another embodiment of the present invention, the needs of the intermediate state are reflected, and the third gamma voltage (GMA3) of the intermediate state may be generated by the use of the third gamma data (Vop3 data) optimized for the intermediate state. Also, the third common voltage data (Vcom3 data) optimized for the intermediate state is stored in the third bank 136. And, the third common voltage (Vcom3) is generated on the basis of the third common voltage data (Vcom3 data) stored in the third bank 136.

The first gamma data (Vop1 data), the second gamma data (Vop2 data) and the third gamma data (Vop3 data) are determined to generate the optimal common voltage for each gray level. The degree of the optimal common voltage deviation (Vop data) is 0V or less than 100 mV.

If the degree of the optimal common voltage deviation (Vop) is 0V or less than 100 mV, it is possible to set the optimal common voltage in all gray levels even though the common voltage is adjusted with respect to any gray levels, to thereby minimize flicker, and furthermore overcome a problem of residual image.

In this case, the first gamma voltage (GMA1) of the initial state, the second gamma voltage (GMA2) of the stable state, and the third gamma voltage (GMA3) of the intermediate state may have the different deviation degree for each common voltage. However, the substantial potential at the pixels of the liquid crystal panel 110 is identical during the initial state, the stable state and the intermediate state. Accordingly, the image quality of the liquid crystal display device 100 is substantially the same during the initial state, the stable state and the intermediate state when the image qualities at the respective states are compared with each other. In other words, since the liquid crystal display device 100 is capable of displaying the substantially the same gray level regardless of the current state, degradation in the image quality may be prevented or minimized.

In some embodiments, multiple intermediate states may be included. For example, the intermediate state further includes a first intermediate state and a second intermediate state.

The present invention can be summarized as below.

The liquid display panel according to some embodiments of the present invention includes the pixel array that suppresses the flicker and short-term residual image when the first gamma voltage and the first common voltage are supplied, and suppresses the flicker and long-term residual image when the second gamma voltage and the second common voltage are supplied. The first gamma voltage is supplied during the initial state and the second gamma voltage is supplied during the stable state, and the initial state is switched to the stable state on the basis of a certain switching point. The first gamma voltage is generated on the basis of the first gamma data that includes the first positive gamma curve and the first negative gamma curve based on the first center voltage. The first positive gamma curve and the first negative gamma curve are symmetrical to each other with respect to the first center voltage, and the first center voltage corresponding to all gray level is non-uniform. The second gamma voltage is generated on the basis of the second gamma data that includes the second positive gamma curve and the second negative gamma curve based on the second center voltage. The second positive gamma curve and the second negative gamma curve are symmetrical to each other with respect to the second center voltage, and the second center voltage corresponding to all gray level is non-uniform.

The first common voltage is decided based on the first deviation data and the second common voltage is decided based on the second deviation data. The deviated degree of the first and the second deviation data is bigger in relatively low gray level than in relatively high gray level. The first common voltage is higher than the second common voltage. The first gamma voltage is higher than the second gamma voltage, and the potential difference of the first gamma voltage and the second gamma voltage is substantially the same in pixel array. The first center voltage is bigger in relatively low gray level than in relatively high gray level. The maximum deviation value of the first and the second deviation data is 0V or less than 100 mV. The lasting time of the initial state depends on the aging condition of the liquid crystal display panel, the switching point is decided on the basis of the lasting time of the initial state, and the first gamma voltage, the first common voltage and the second common voltage are adjusted, whereby the degree of flicker, short-term residual image and long-term residual image remain substantially constant during the initial state and the stable state.

The liquid crystal display device according to some embodiments of the present invention includes a liquid crystal panel. The liquid crystal panel includes a timing controller which can generate a voltage control signal for switching an initial state to a stable state by using a certain switching point, a voltage generating unit which can receive the voltage control signal, supplies the first gamma voltage and the first common voltage in the initial state, and supplies the second gamma voltage and the second common voltage in the stable state, a data driver which can receive the first gamma voltage in the initial state and the second gamma voltage in the stable state, and a pixel array which can suppress short-term residual image if the first gamma voltage and the first common voltage are supplied, and can suppress long-term residual image if the second gamma voltage and the second common voltage are supplied.

The voltage generating unit at least includes the first bank, which can store the first gamma data and the first common voltage data, and the second bank, which can store the second gamma data and the second common voltage data, wherein the first gamma voltage is generated on the basis of the first gamma data and the second gamma voltage is generated on the basis of the second gamma data. The first common voltage is generated on the basis of the first common voltage data and the second common voltage is generated on the basis of the second common voltage data. The voltage generating unit further includes the third bank. The timing controller can generate the voltage control signal to switch the initial state to the intermediate state in the first switching point and switch the intermediate state to the stable state in the second switching point. The voltage generating unit can supply the third gamma voltage and the third common voltage in the intermediate state. The third bank can store the third gamma data and the third common voltage data. The third gamma voltage can be generated on the basis of the third gamma data and the third common voltage can be generated on the basis of the third common voltage data. The first common voltage is the same in all gray level, and the first gamma data includes the first positive gamma curve and the first negative gamma curve, and the first positive gamma curve and the first negative gamma curve are asymmetrical to each other with respect to the first common voltage. The second common voltage is same in all gray level, and the second gamma data includes the second positive gamma curve and the second negative gamma curve, and the second positive gamma curve and the second negative gamma curve are asymmetrical to each other with respect to the second common voltage. The first common voltage and the second common voltage are different from each other, and the first gamma data and the second gamma data are different from each other. The switching point is determined relative to the elapsed operation time of the liquid crystal panel.

The method for driving a liquid crystal display device comprises generating, by a timing controller, a voltage control signal to switch from an initial state to a stable state by using a predetermined switching point; receiving, by a voltage generating unit, the voltage control signal, and supplying a first gamma voltage and a first common voltage during the initial state, and supplying a second gamma voltage and a second common voltage during the stable state; receiving, by a data driver, the first gamma voltage during the initial state and receiving the second gamma voltage during the stable state; and suppressing, by a liquid crystal panel including a pixel array, a short-term residual image when the first gamma voltage and the first common voltage are applied and suppressing a long-term residual image when the second gamma voltage and the second common voltage are applied.

According to the present invention, the common voltage and the gamma voltage may be adjusted on the basis of the operation time to reduce or remove the residual image of the initial state.

Furthermore, the common voltage and the gamma voltage may be adjusted on the basis of the operation time to reduce a final test time including a residual image test, whereby a manufacturing cost or a manufacturing time may be reduced, and the residual image or flicker may be reduced to enhance manufacturing efficiency.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention claimed is:

1. A liquid crystal display panel comprising:

a pixel array capable of suppressing a degree of flicker and a short-term residual image when a first gamma voltage and a first common voltage are received and capable of suppressing the degree of flicker and a long-term residual image when a second gamma voltage and a second common voltage are received, wherein the first gamma voltage is received during an initial state and the second gamma voltage is received during a stable state, and the initial state switches to the stable state on a basis of a predetermined switching point, wherein the first gamma voltage is generated by using a first gamma data, which includes a first positive gamma curve and a first negative gamma curve on a basis of a first center voltage, wherein the first positive gamma curve and the first negative gamma curve are symmetrical to each other with respect to the first center voltage, and the first center voltage has a different value for each gray level, wherein the first common voltage is received during the initial state and the second common voltage is received during the stable state, wherein the first common voltage and the second common voltage are different from each other and the first gamma data and the second gamma data are different from each other, wherein the second gamma voltage is generated by using a second gamma data, which includes a second positive gamma curve and a second negative gamma curve on a basis of a second center voltage, and wherein the second positive gamma curve and the second negative gamma curve are symmetrical to each other with respect to the second center voltage, and the second center voltage has a different value for each gray level.

2. The liquid crystal display panel of claim 1, wherein the first common voltage is determined on a basis of a first deviation data and the second common voltage is determined on a basis of a second deviation data, wherein the first and second deviation data have a degree of deviation at a lower gray level that is larger than a degree of deviation at a higher gray level.

3. The liquid crystal display panel of claim 2, wherein a maximum deviation value of the first and second deviation data is equal to 0V or less than 100 mV.

4. The liquid crystal display panel of claim 1, wherein the first common voltage is higher than the second common voltage.

5. The liquid crystal display panel of claim 4, wherein the first gamma voltage is higher than the second gamma voltage, wherein a voltage potential difference between the first gamma voltage and the second gamma voltage is substantially same at the pixel array.

6. The liquid crystal display panel of claim 1, wherein a voltage at a lower gray level of the first center voltage is larger than a voltage at a higher gray level of the first center voltage.

7. The liquid crystal display panel of claim 1, wherein a duration of the initial state is based on aging conditions of the liquid crystal display panel, wherein the predetermined switching point is determined with respect to the duration of the initial state, and the first gamma voltage, the first common voltage and the second common voltage are adjusted, whereby the degree of flicker, the short-term residual image and the long-term residual image remain substantially unchanged during the initial state and the stable state.

8. A liquid crystal display device comprising:

a timing controller capable of generating a voltage control signal to switch from an initial state to a stable state by using a predetermined switching point;

a voltage generating unit capable of receiving the voltage control signal, supplying a first gamma voltage and a first common voltage during the initial state, and supplying a second gamma voltage and a second common voltage during the stable state;

a data driver capable of receiving the first gamma voltage during the initial state and capable of receiving the second gamma voltage during the stable state; and a liquid crystal panel including a pixel array capable of suppressing a short-term residual image when the first gamma voltage and the first common voltage are applied and capable of suppressing a long-term residual image when the second gamma voltage and the second common voltage are applied, wherein the first common voltage and the second common voltage are different from each other and the first gamma data and the second gamma data are different from each other, wherein the first gamma voltage is generated by using a first gamma data, which includes a first positive gamma curve and a first negative gamma curve on a basis of a first center voltage, wherein the first positive gamma curve and the first negative gamma curve are symmetrical to each other with respect to the first center voltage, and the first center voltage has a different value for each gray level, wherein the second gamma voltage is generated by using a second gamma data, which includes a second positive gamma curve and a second negative gamma curve on a basis of a second center voltage, and wherein the second positive gamma curve and the second negative gamma curve are symmetrical to each other with respect to the second center voltage, and the second center voltage has a different value for each gray level.

9. The liquid crystal display device of claim 8, wherein the voltage generating unit includes at least a first bank capable of storing the first gamma data and the first common voltage and a second bank capable of storing the second gamma data and the second common voltage, wherein the first gamma voltage is generated on a basis of the first gamma data and the second gamma voltage is generated on a basis of the second gamma data.

10. The liquid crystal display device of claim 9, further including a third bank, wherein the timing controller is capable of generating the voltage control signal to switch from the initial state to an intermediate state with a first predetermined switching point then switch from the intermediate state to the stable state with a second predetermined switching point, wherein the voltage generating unit is capable of supplying a third gamma voltage and a third common voltage during the intermediate state, wherein the third bank is capable of storing a third gamma data and the third common voltage, wherein the third gamma voltage is generated on a basis of the third gamma data.

11. The liquid crystal display device of claim 10, wherein the second common voltage is uniform to all gray levels, and wherein the second positive gamma curve and the second negative gamma curve are asymmetrical to each other with respect to the second common voltage.

12. The liquid crystal display device of claim 11, wherein the switching point is determined with respect to operation time of the liquid crystal panel.

13. The liquid crystal display device of claim 9, wherein the first common voltage is uniform to all gray levels, and wherein the first positive gamma curve and the first negative gamma curve are asymmetrical to each other with respect to the first common voltage.

14. A method for driving a liquid crystal display device comprising:

generating, by a timing controller, a voltage control signal to switch from an initial state that spans a plurality of first frame periods of the liquid crystal display device to a stable state that is subsequent to the initial state, the stable state spanning a plurality of second frame periods of the liquid crystal display panel, with a predetermined switching point;

receiving, by a voltage generating unit, the voltage control signal, and supplying a first gamma voltage and a first common voltage during the initial state, and supplying a second gamma voltage and a second common voltage during the stable state;

receiving, by a data driver, the first gamma voltage during the initial state and receiving the second gamma voltage during the stable state; and suppressing, by a liquid crystal panel including a pixel array, a short-term residual image when the first gamma voltage and the first common voltage are applied and suppressing a long-term residual image when the second gamma voltage and the second common voltage are applied, wherein the first common voltage and the second common voltage are different from each other and the first gamma data and the second gamma data are different from each other, wherein the first gamma voltage is generated by using a first gamma data, which includes a first positive gamma curve and a first negative gamma curve on a basis of a first center voltage, wherein the first positive gamma curve and the first negative gamma curve are symmetrical to each other with respect to the first center voltage, and the first center voltage has a different value for each gray level, wherein the second gamma voltage is generated by using a second gamma data, which includes a second positive gamma curve and a second negative gamma curve on a basis of a second center voltage, and wherein the second positive gamma curve and the second negative gamma curve are symmetrical to each other with respect to the second center voltage, and the second center voltage has a different value for each gray level.

* * * * *